US010688791B2

(12) United States Patent
Ou et al.

(10) Patent No.: US 10,688,791 B2
(45) Date of Patent: Jun. 23, 2020

(54) PRINTER CLEAN SYSTEM

(71) Applicant: TECO IMAGE SYSTEMS CO., LTD., Taipei (TW)

(72) Inventors: Teng-Yuan Ou, Taipei (TW); Yu-Jen Chang, Taipei (TW)

(73) Assignee: TECO IMAGE SYSTEMS CO., LTD., Taipei (TW)

( * ) Notice: Subject to any disclaimer, the term of this patent is extended or adjusted under 35 U.S.C. 154(b) by 0 days.

(21) Appl. No.: 16/178,282

(22) Filed: Nov. 1, 2018

(65) Prior Publication Data

US 2020/0061998 A1 Feb. 27, 2020

(30) Foreign Application Priority Data

Aug. 23, 2018 (TW) ..... 107129518 A

(51) Int. Cl.
*B41J 2/16* (2006.01)
*B41J 2/165* (2006.01)

(52) U.S. Cl.
CPC ..... *B41J 2/16535* (2013.01)

(58) Field of Classification Search
None
See application file for complete search history.

(56) References Cited

U.S. PATENT DOCUMENTS

2008/0129776 A1* 6/2008 Taira ..... B41J 2/16526 347/33
2015/0042721 A1 2/2015 Mano et al.
2017/0266974 A1 9/2017 Hamaguchi et al.

FOREIGN PATENT DOCUMENTS

CN 104191820 A 12/2014
JP 2009045898 A 3/2009
JP 2017061090 A 3/2017

* cited by examiner

*Primary Examiner* — Erica S Lin
(74) *Attorney, Agent, or Firm* — Kirton McConkie; Evan R. Witt

(57) ABSTRACT

A printer clean system includes a base, an ink stack assembly, a scraper assembly, a power transmission device and a driving device. The ink stack assembly is disposed on a first accommodation groove. The scraper assembly is disposed on a second accommodation groove. The power transmission device is connected with the driving device, the ink stack assembly, and the scraper assembly. When the power transmission device is rotated to a first angle, the ink stack assembly is brought to an ink stack clean position. When the power transmission device is rotated to a second angle, the scraper assembly is brought to a scraper clean position. When the power transmission device is rotated to a third angle, the ink stack assembly is located at an ink stack return position, and the scraper assembly is located at a scraper return position. Therefore, the pollution can be avoided.

10 Claims, 10 Drawing Sheets

9

PRINTER CLEAN SYSTEM

CROSS-REFERENCE TO RELATED APPLICATION

This application claims priority from Taiwan Patent Application No. 107129518, filed on Aug. 23, 2018, the entire contents of which are incorporated herein by reference for all purposes.

FIELD OF THE INVENTION

The present invention relates to a clean system, and more particularly to a printer clean system.

BACKGROUND OF THE INVENTION

A printer clean system is a system of maintaining the print quality and the nozzle availability. The print clean system mainly includes an ink stack and a scarper assembly.

In general, the ink stack can be classified as a lift type and a swing arm type. The scraper assembly can be classified as a fixed type and a reciprocating type. No matter what form the ink stack or the scraper assembly is, problems such as splashing and contamination exist. Specifically, since the ink stack and the scraper assembly are independently controlled to perform ink extraction and pollution scraping, and the structures are independent and complicated, the operation error is larger. In addition, the ink stack and the scraper assembly that operate independently use more materials, which also makes the assembly cost more. Furthermore, since the two operate independently, the driving is also carried out independently, and it is difficult to accurately control and adjust the contact area and the cleaning force during cleaning, which may cause unpredictable pollution problems.

Therefore, there is a need of providing a printer clean system, which can accurately and synchronously control lifting and contact area and further avoid the pollution problems, distinct from the prior art in order to solve the above drawbacks.

SUMMARY OF THE INVENTION

Some embodiments of the present invention are to provide a printer clean system in order to overcome at least one of the above-mentioned drawbacks encountered by the prior arts.

The present invention provides a printer clean system. By rotating the power transmission device to the first angle, the second angle and the third angle, the ink stack assembly is respectively brought to an ink stack clean position, an ink stack return position and the ink stack return position by the power transmission device, and the scraper assembly is simultaneously brought to a scraper return position, a scraper clean position and the scraper return position by the power transmission device. In other words, through the different phases of the power transmission device of the printer clean system, the ink stack cleaning, the scraper cleaning, and the ink stack returning and the scraper returning are continuously and respectively performed. Since the actions are interactively and continuously operated, the operation error is extremely small, hence the clean effectivity is effectively enhanced, and the pollution problems are avoided.

The present invention also provides a printer clean system. Since the power transmission device is specially designed, the printer clean system can be driven by a single driving device. Not only the utilized materials are less, but also the cost of assemblies are lower. Meanwhile, because the control of single driving is easier, the advantages of accurately controlling and adjusting the contact area and the cleaning force during cleaning are achieved.

In accordance with an aspect of the present invention, there is provided a printer clean system. The printer clean system includes a base, an ink stack assembly, a scraper assembly, a power transmission device and a driving device. The base has a first accommodation groove and a second accommodation groove. The first accommodation groove is disposed adjacent to the second accommodation groove. The ink stack assembly is disposed on the first accommodation groove. The scraper assembly is disposed on the second accommodation groove. The power transmission device is penetrated through the first accommodation groove and the second accommodation groove and connected with the ink stack assembly and the scraper assembly. The driving device is connected with the power transmission device for driving the power transmission device. When the power transmission device is rotated to a first angle, the ink stack assembly is brought to an ink stack clean position by the power transmission device, and the scraper assembly is brought to a scraper return position by the power transmission device. When the power transmission device is rotated to a second angle, the ink stack assembly is brought to an ink stack return position by the power transmission device, and the scraper assembly is brought to a scraper clean position by the power transmission device. When the power transmission device is rotated to a third angle, the ink stack assembly is brought to the ink stack return position by the power transmission device, and the scraper assembly is brought to the scraper return position by the power transmission device.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
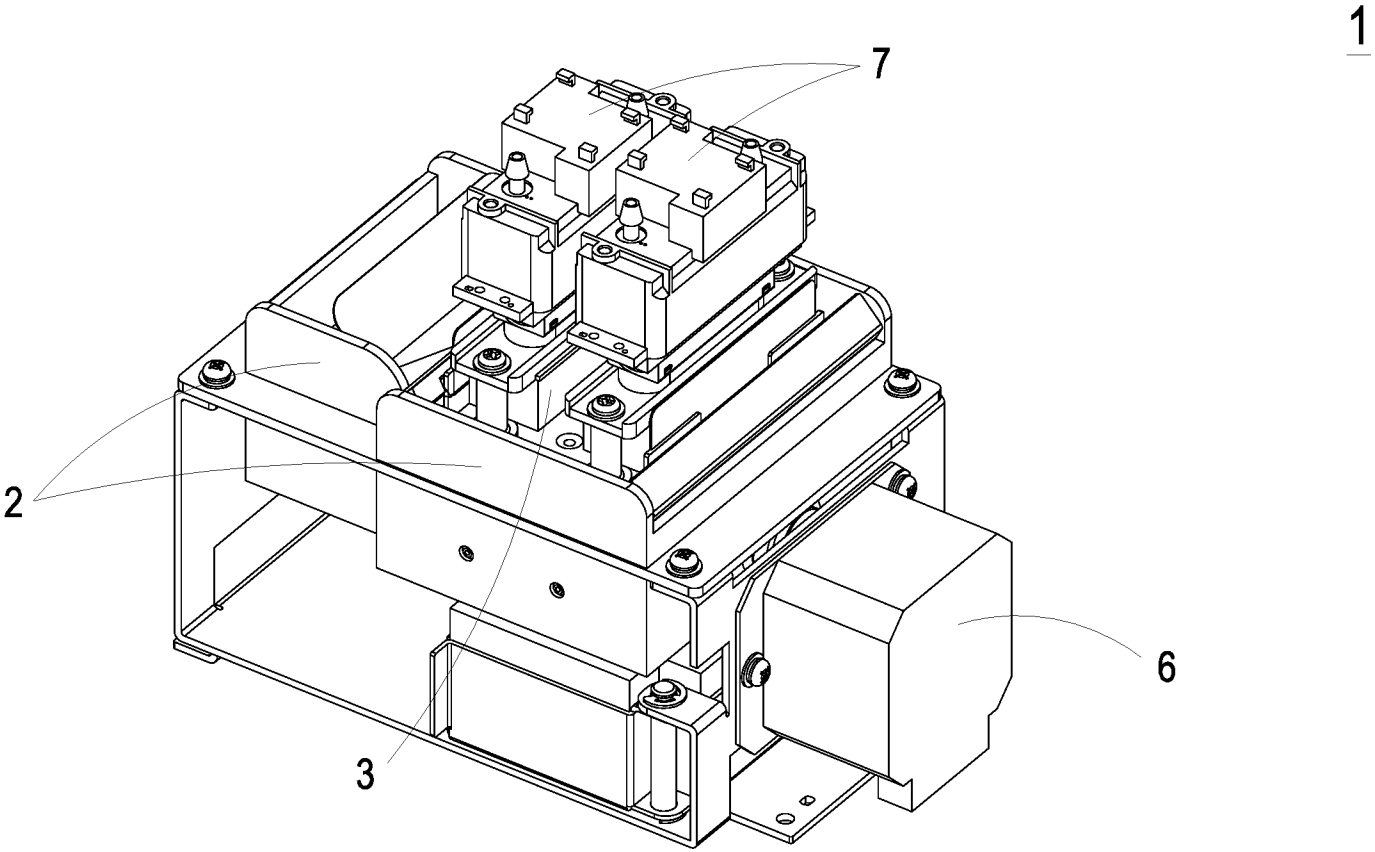
FIG. 1A schematically illustrates the structure of a printer clean system according to an embodiment of the present invention.
Figure 1B:
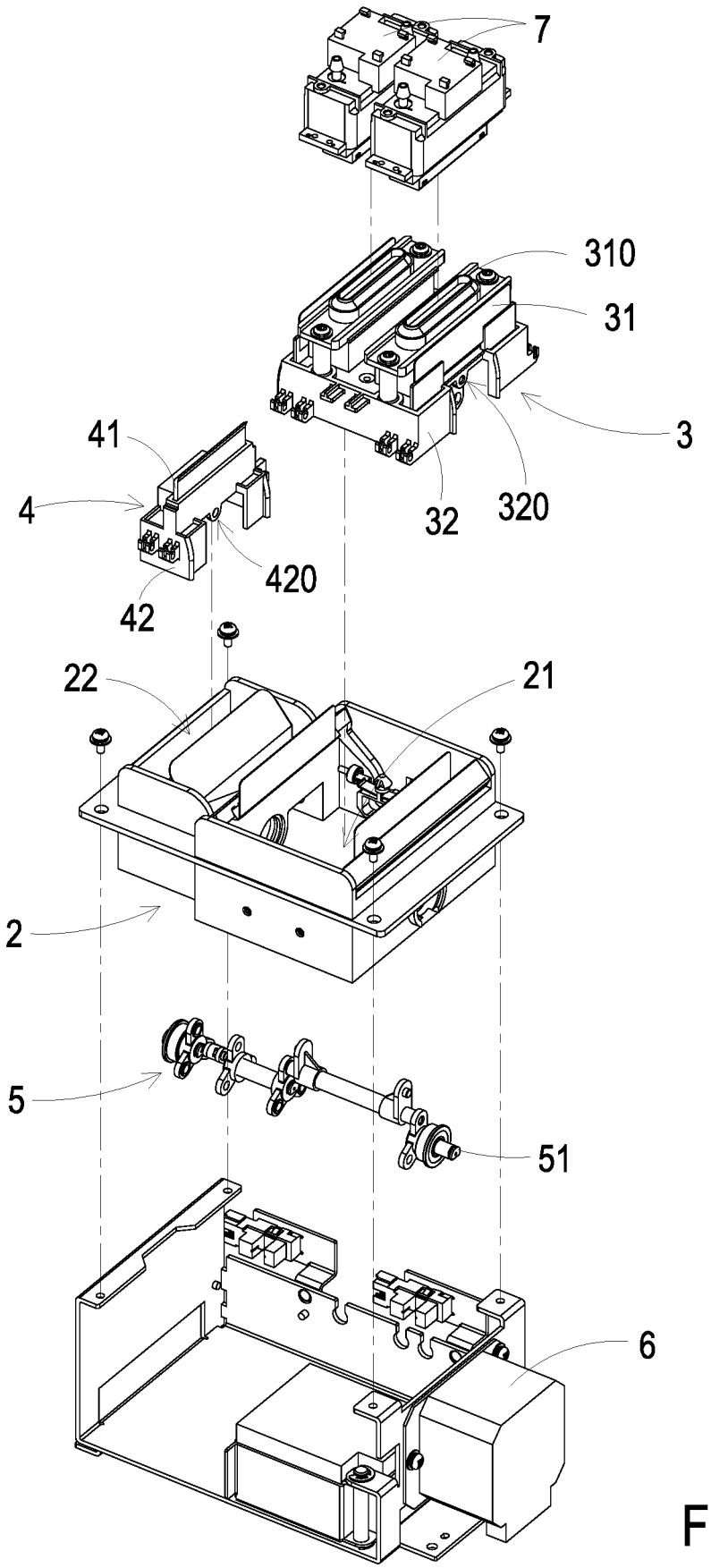
FIG. 1B schematically illustrates the exploded view of the printer clean system shown in FIG. 1A.
Figure 3A:
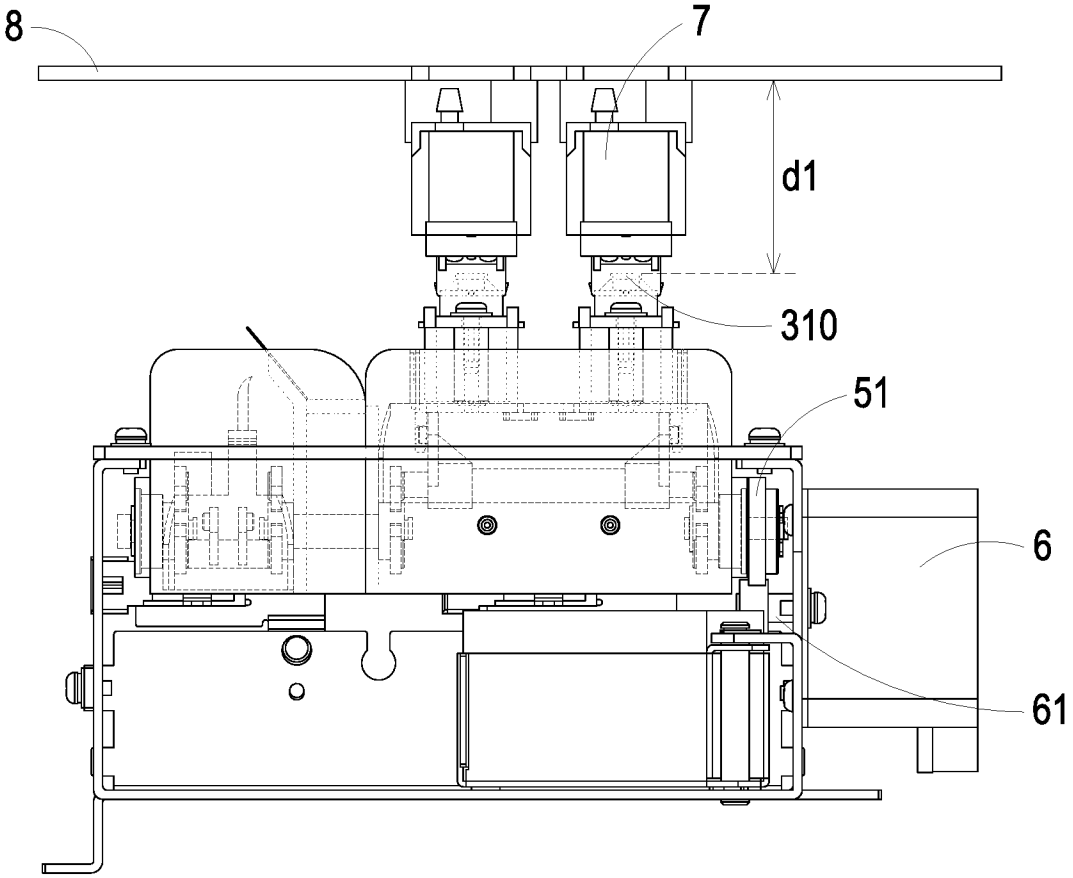
FIG. 3A schematically illustrates the front view of a printer clean system when a power transmission device of the printer clean system is rotated to a first angle.
Figure 3C:
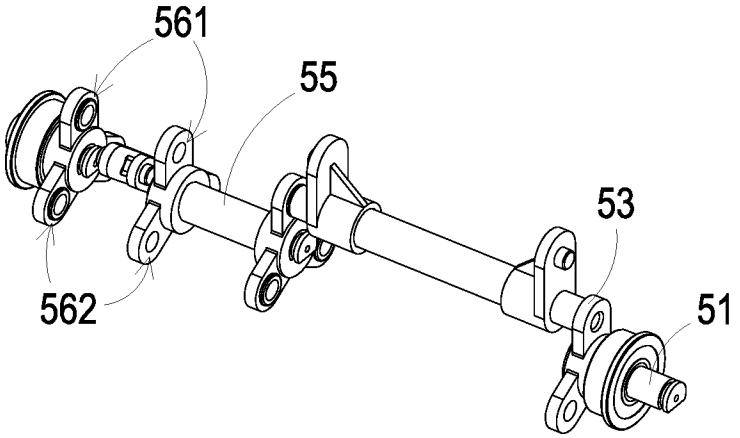
FIG. 3C schematically illustrates the structure of the power transmission device when the power transmission device is rotated to the first angle.
Figure 3B:
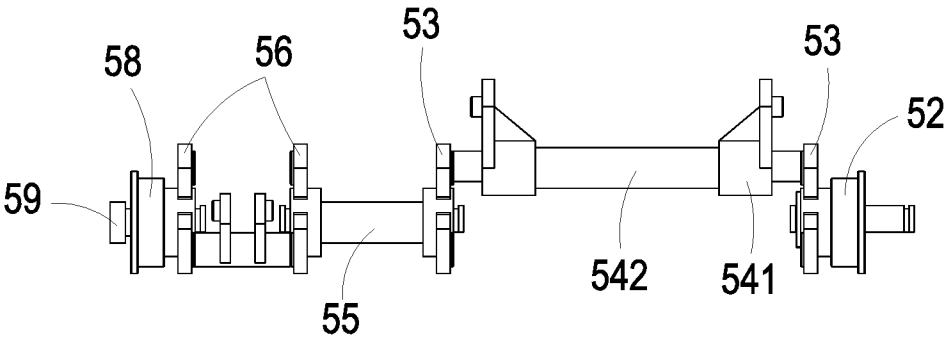
FIG. 3B schematically illustrates the front view of the power transmission device when the power transmission device is rotated to the first angle.
Figure 4A:
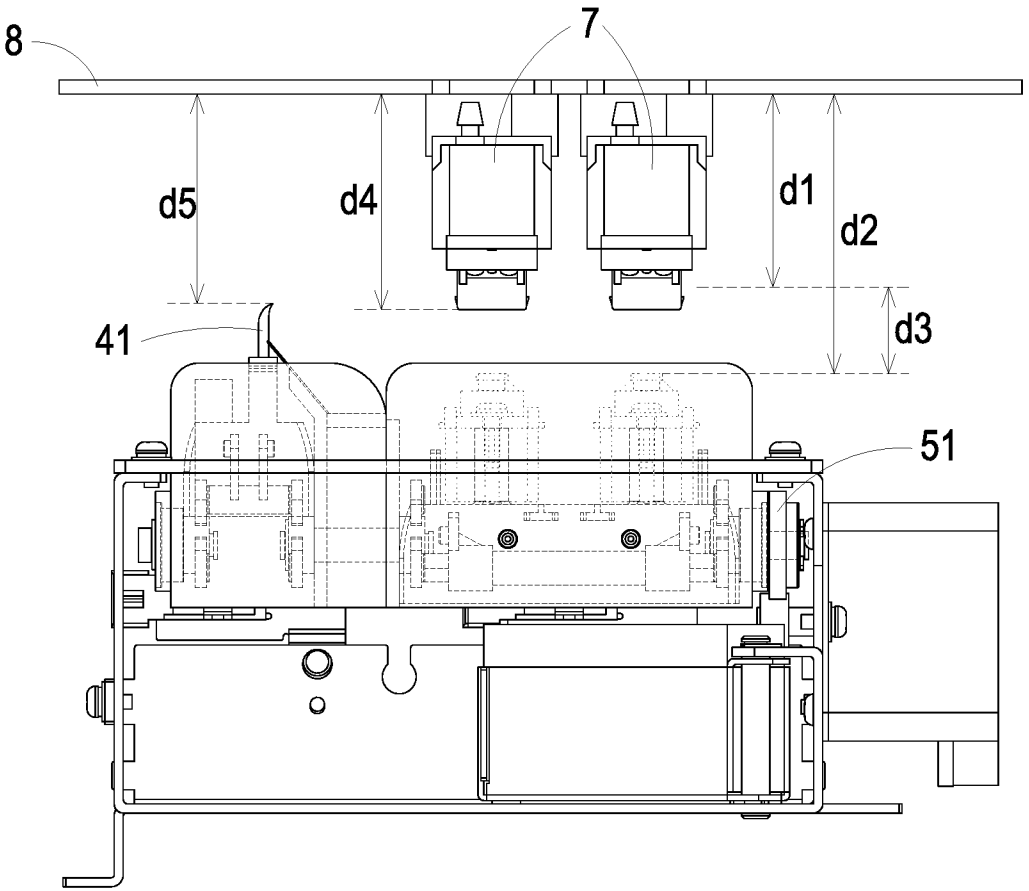
FIG. 4A schematically illustrates the front view of a printer clean system when a power transmission device of the printer clean system is rotated to a second angle.
Figure 4C:
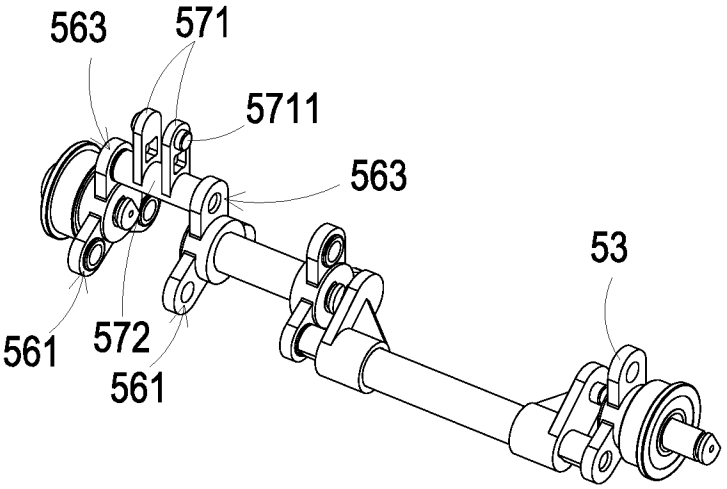
FIG. 4C schematically illustrates the structure of the power transmission device when the power transmission device is rotated to the second angle.
Figure 4B:
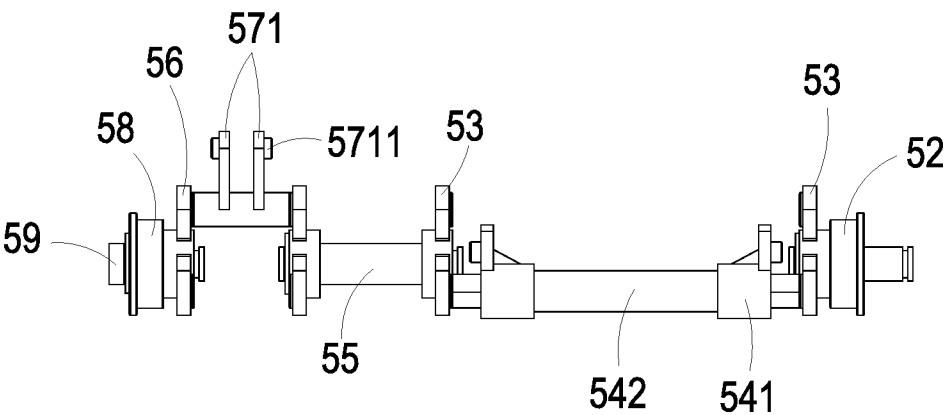
FIG. 4B schematically illustrates the front view of the power transmission device when the power transmission device is rotated to the second angle.
Figure 5A:
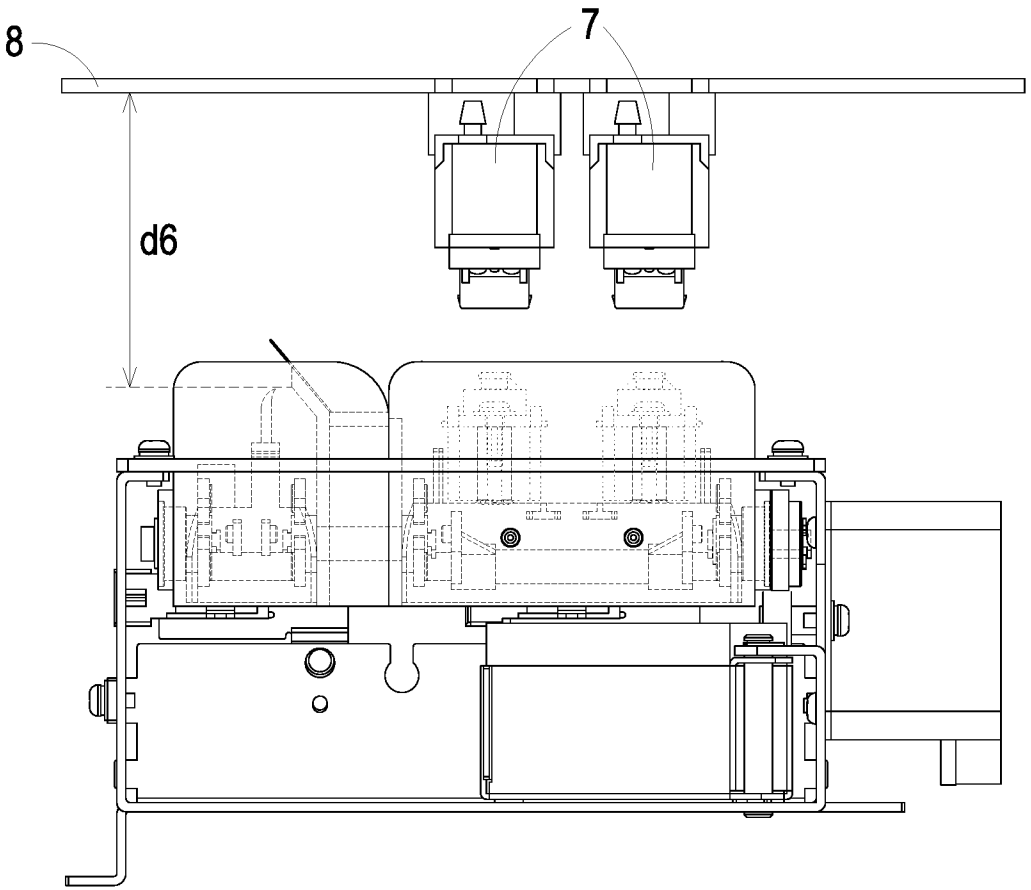
FIG. 5A schematically illustrates the front view of a printer clean system when a power transmission device of the printer clean system is rotated to a third angle.
Figure 5C:
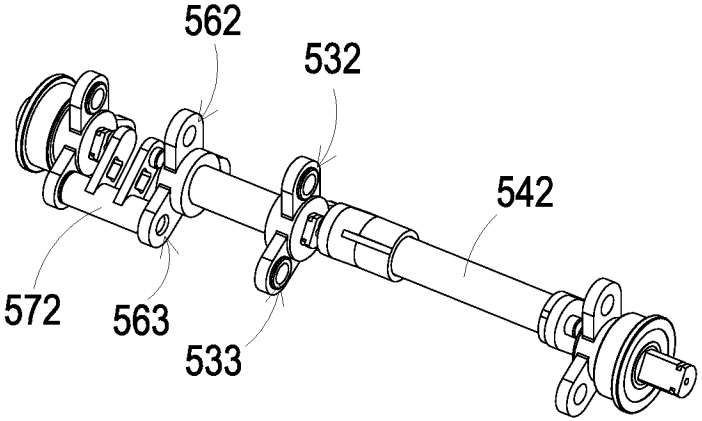
FIG. 5C schematically illustrates the structure of the power transmission device when the power transmission device is rotated to the third angle.
Figure 5B:
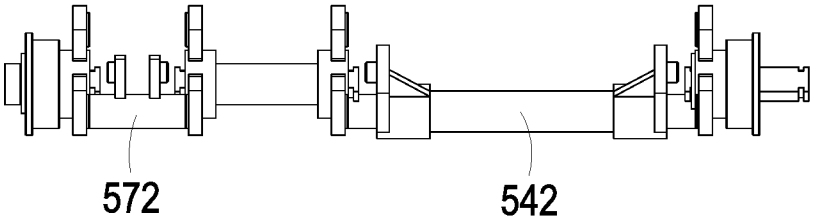
FIG. 5B schematically illustrates the front view of the power transmission device when the power transmission device is rotated to the third angle.

Please refer to FIG. 1A and FIG. 1B. FIG. 1A schematically illustrates the structure of a printer clean system according to an embodiment of the present invention. FIG. 1B schematically illustrates the exploded view of the printer clean system shown in FIG. 1A. As shown in FIG. 1A and FIG. 1B, a printer clean system 1 according to an embodiment of the present invention includes a base 2, an ink stack assembly 3, a scraper assembly 4, a power transmission device 5 and a driving device 6. The base 2 has a first accommodation groove 21 and a second accommodation groove 22. The first accommodation groove 21 is disposed adjacent to the second accommodation groove 22. The ink stack assembly 3 is disposed on the first accommodation groove 21. The scraper assembly 4 is disposed on the second accommodation groove 22. In some embodiments, since the volume of the ink stack assembly 3 is usually larger than the volume of the scraper assembly 4, the volume of the first accommodation groove 21 is preferred to be larger than the volume of the second accommodation groove 22, but not limited herein. The power transmission device 5 is penetrated through the first accommodation groove 21 and the second accommodation groove 22 and connected with the ink stack assembly 3 and the scraper assembly 4. The driving device 6 is connected with the power transmission device 5 for driving the power transmission device 5. When the power transmission device 5 is rotated to a first angle (as shown in FIGS. 3A-3C), the ink stack assembly 3 is brought to an ink stack clean position by the power transmission device 5, and the scraper assembly 4 is brought to a scraper return position by the power transmission device 5. When the power transmission device 5 is rotated to a second angle (as shown in FIGS. 4A-4C), the ink stack assembly 3 is brought to an ink stack return position by the power transmission device 5, and the scraper assembly 4 is brought to a scraper clean position by the power transmission device 5. When the power transmission device 5 is rotated to a third angle (as shown in FIGS. 5A-5C), the ink stack assembly 3 is brought to the ink stack return position by the power transmission device 5, and the scraper assembly 4 is brought to the scraper return position by the power transmission device 5. In brief, through the different phases of the power transmission device 5 of the printer clean system 1, the ink stack cleaning, the scraper cleaning, and the ink stack returning and the scraper returning are continuously and respectively performed. Since the actions are interactively and continuously operated, the operation error is extremely small, hence the clean effectivity is effectively enhanced, and the pollution problems are avoided.

Figure 2:
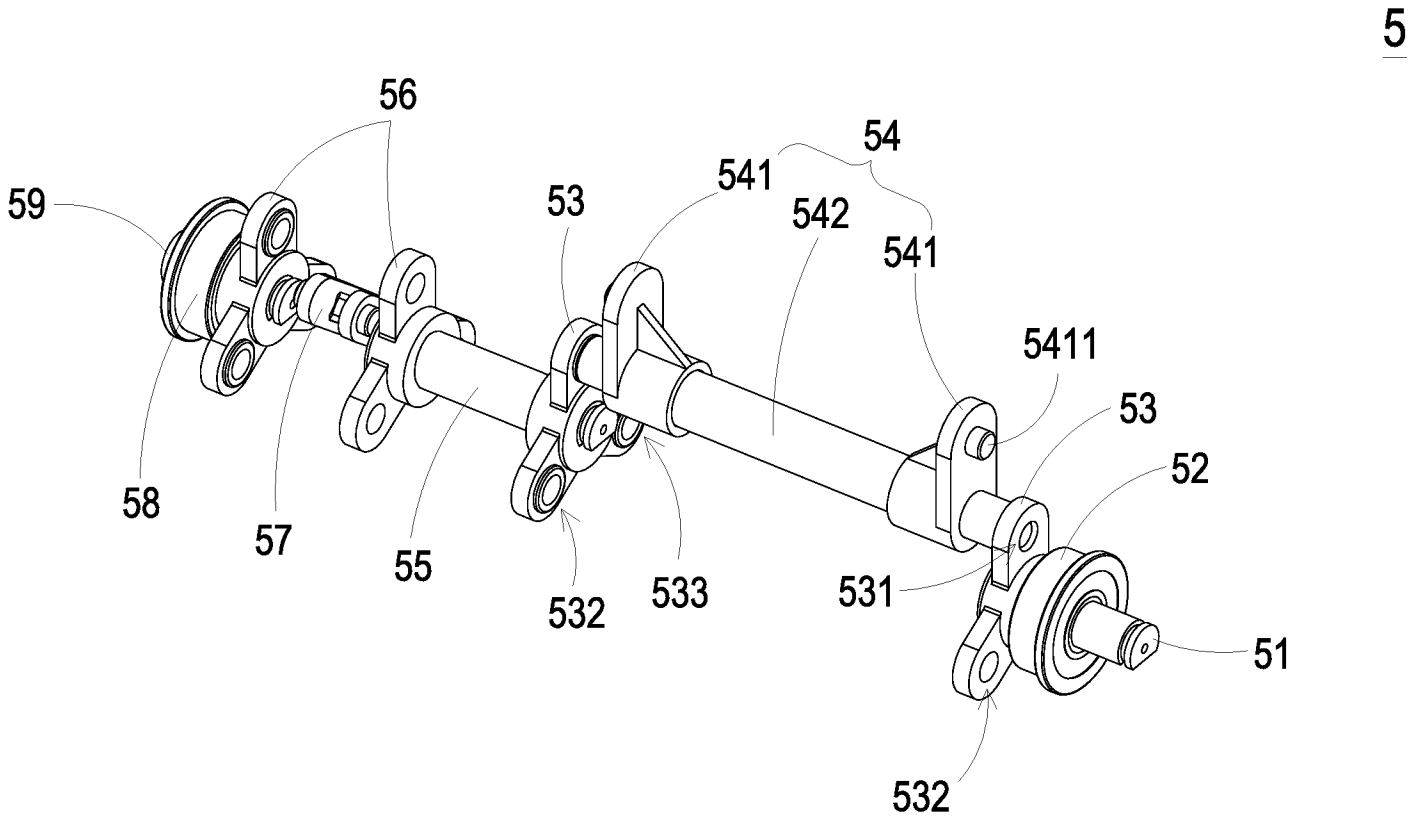
FIG. 2 schematically illustrates the detailed structure of a power transmission device of a printer clean system according to an embodiment of the present invention.

Please refer to FIGS. 1A-5C. FIG. 2 schematically illustrates the detailed structure of a power transmission device of a printer clean system according to an embodiment of the present invention. FIG. 3A schematically illustrates the front view of a printer clean system when a power transmission device of the printer clean system is rotated to a first angle. FIG. 3B schematically illustrates the front view of the power transmission device when the power transmission device is rotated to the first angle. FIG. 3C schematically illustrates the structure of the power transmission device when the power transmission device is rotated to the first angle. FIG. 4A schematically illustrates the front view of a printer clean system when a power transmission device of the printer clean system is rotated to a second angle. FIG. 4B schematically illustrates the front view of the power transmission device when the power transmission device is rotated to the second angle. FIG. 4C schematically illustrates the structure of the power transmission device when the power transmission device is rotated to the second angle. FIG. 5A schematically illustrates the front view of a printer clean system when a power transmission device of the printer clean system is rotated to a third angle. FIG. 5B schematically illustrates the front view of the power transmission device when the power transmission device is rotated to the third angle. FIG. 5C schematically illustrates the structure of the power transmission device when the power transmission device is rotated to the third angle. As shown in FIGS. 1A-5C, the power transmission device 5 of the printer clean system 1 includes a polygonal shaft 51, a first receiving portion 52, two first cranks 53, a first connection rod 54, a transmission rod 55, two second cranks 56, a second connection rod 57, a second receiving portion 58 and a fixing shaft 59. The polygonal shaft 51 is pivotally disposed on the first receiving portion 52. One of the two first cranks 53 is pivotally disposed on the first receiving portion 52, and one of the two second cranks 56 is pivotally disposed on the second receiving portion 58.

Each of the first cranks 53 has a first phase hole 531, a second phase hole 532 and a third phase hole 533. A phase difference between the first phase hole 531 and the second phase hole 532 is 30 to 120 degrees, a phase difference between the second phase hole 532 and the third phase hole 533 is 30 to 120 degrees, and a phase difference between the third phase hole 533 and the first phase hole 531 is 30 to 120 degrees. In other words, each first crank 53 has three holes (i.e. the first phase hole 531, the second phase hole 532 and the third phase hole 533). The central angle between the center of each of the three phase holes and the center of the adjacent phase hole is between 30 degrees and 120 degrees, so that every time after the power transmission device 5 is rotated by 30-120 degrees, the power transmission device 5 is switched to the next phase, but not limited thereto. The first connection rod 54 is disposed between the two first cranks 53 and installed on corresponded the two first phase holes 531 of the two first cranks 53. It should be noted that in the embodiment described herein, the phase difference between the first phase hole 531 and the second phase hole 532, the phase difference between the second phase hole 532 and the third phase hole 533, and the phase difference between the third phase hole 533 and the first phase hole 531 can be identical or can be different. It is only necessary to have a phase difference of a certain stroke to complete the three-phase switching, which can be varied according to practical demands and application design. It is not limited by the angles described in this embodiment. For example, as shown in the drawings of the present invention, the phase differences are all shown as 120 degrees, but the phase differences are not limited thereto, practically.

Correspondingly, each of the second cranks 56 has a fourth phase hole 561, a fifth phase hole 562 and a sixth phase hole 563. A phase difference between the fourth phase hole 561 and the fifth phase hole 562 is 30 to 120 degrees, a phase difference between the fifth phase hole 562 and the sixth phase hole 563 is 30 to 120 degrees, a phase difference between the sixth phase hole 563 and the fourth phase hole 561 is 30 to 120 degrees, and the fourth phase hole 561, the fifth phase hole 562 and the sixth phase hole 563 are respectively corresponded to the first phase hole 531, the second phase hole 532 and the third phase hole 533. The second connection rod 57 is disposed between the two second cranks 56 and installed on corresponded the two sixth phase holes 563 of the two second cranks 56. In addition, distinct from the first crank 53 pivotally disposed on the first receiving portion 52 and the second crank 56 pivotally disposed on the second receiving portion 58, the other first crank 53 and the other second crank 56 are connected with the transmission rod 55. In other words, the transmission rod 55 is disposed between the first connection rod 54 and the second connection rod 57, and respectively connected to one of the two first cranks 53 and one of the two second cranks 56. The polygonal shaft 51, the two first cranks 53, the transmission rod 55 and the two second cranks 56 are preferred to be equivalently and coaxially rotated. As a result, when the polygonal shaft 51 is driven, the rotational phase may transmit to the first connection rod 54 and the second connection rod 57.

In some embodiments, the driving device 6 of the printer clean system 1 is a motor. A rotating shaft 61 of the motor is connected with the polygonal shaft 51. The polygonal shaft 51, the first receiving portion 52, the first crank 53 pivotally disposed on the first receiving portion 52, the first connection rod 54, the first crank 53 connected to the transmission rod 55, the transmission rod 55, the second crank 56 connected to the transmission rod 55, the second connection rod 57, the second crank 56 pivotally disposed on the second receiving portion 58, the second receiving portion 58 and the fixing shaft 59 are sequentially arranged. The polygonal shaft 51 is disposed adjacent to the driving device 6, and the fixing shaft 59 is preferred to be fixed on a housing of the printer, but not limited herein.

In some embodiments, the ink stack assembly 3 includes at least an ink stack 31 and a first body 32. Each ink stack 31 is disposed on the first body 32. Each of the ink stack 31 has an ink absorption head 310, and when the ink stack assembly 3 is located at the ink stack clean position, each of the ink absorption head 310 is correspondingly contacted with an ink cartridge 7. In addition, the first connection rod 54 includes at least a first connection portion 541 and a first rod 542. The first connection portion 541 is disposed or formed on the first rod 542. The first connection portion 541 has a first engaging portion 5411, and the first engaging portion 5411 is engaged with a first engaging hole 320 of the first body 32 so as to be located.

Similarly, in some embodiments, the scraper assembly 4 includes a scraper 41 and a second body 42. The scraper 41 is disposed on the second body 42. Furthermore, the second connection rod 57 includes at least a second connection portion 571 and a second rod 572. The second connection portion 571 is disposed or formed on the second rod 572. The second connection portion 571 has a second engaging portion 5711, and the second engaging portion 5711 is engaged with a second engaging hole 420 of the second body 42 so as to be located.

The following is a description of the operation of the power transmission device 5 being driven to rotate at the first angle, the second angle, and the third angle. Please refer to FIGS. 3A-5C again. The ink cartridge 7 of the printer is installed on an ink cartridge supporting element 8. When the power transmission device 5 is driven by the driving device 6 to rotate at the first angle, the ink stack assembly 3 is brought to the ink stack clean position by the power transmission device 5. While in the ink stack clean position, the distance between the ink absorption head 310 of the ink stack 31 and the ink cartridge supporting element 8 is a first distance d1. When the power transmission device 5 is driven by the driving device 6 to rotate at the second angle, the ink stack assembly 3 is brought to the ink stack return position. While in the ink stack return position, the distance between the ink absorption head 310 of the ink stack 31 and the ink cartridge supporting element 8 is a second distance d2. That is, the total moving distance of the ink absorption head 310 lifted downwardly from the ink stack clean position to the ink stack return position is a difference equal to the second distance d2 minus the first distance d1, which is referred herein as a third distance d3. The height difference between the ink stack clean position and the ink stack return position is the third distance d3, where d3=d2−d1.

Meanwhile, when the power transmission device 5 is driven by the driving device 6 to rotate at the second angle, the scraper assembly 4 is brought to the scraper clean position by the power transmission device 5. A fourth distance d4 is the distance between the bottom of the ink cartridge 7 and the ink cartridge supporting element 8. While in the scarper clean position, the distance between the very front end of the scraper 41 and the ink cartridge supporting element 8 is a fifth distance d5. To effectively scrape the ink residue left on the bottom of the ink cartridge 7, the fourth distance d4 must be larger than the fifth distance d5. In other words, the very front end of the scraper 41 has to be higher than the bottom of the ink cartridge 7, so that the ink cartridge 7 can be cleaned by the scraper 41. In addition, the scraper 41 is preferred to be made of flexible materials, but not limited thereto.

Moreover, when the power transmission device 5 is driven by the driving device 6 to rotate at the third angle, the ink stack assembly 3 and the scraper assembly 4 are respectively located at the ink stack return position and the scraper return position. While in the scraper return position, the distance between the very front end of the scraper 41 and the ink cartridge supporting element 8 is a sixth distance d6. The sixth distance d6 can be larger than or equal to the second distance d2. That is, the height difference between the scraper return position and the scraper clean position can be larger than or equal to the height difference between the ink stack return position and the ink stack clean position, but not limited herein.

It should be noted that since the first phase hole 531, the second phase hole 532 and the third phase hole 533 of the first cranks 53 of the power transmission device 5 of the printer clean system 1 are corresponded to the fourth phase hole 561, the fifth phase hole 562 and the sixth phase hole 563 of the second cranks 56 of the power transmission device 5 of the printer clean system 1, the first connection rod 54 is installed on the first phase hole 531, and the second connection rod 57 is installed on the sixth phase hole 563, when the first phase hole 531 and the fourth phase hole 561 are rotated to the highest position, the power transmission device 5 is rotated at the first angle so as to lift the ink stack assembly 3 up. When the third phase hole 533 and the sixth phase hole 563 are rotated to the highest position, the power transmission device 5 is rotated at the second angle so as to lift the scraper assembly 4 up. When the second phase hole 532 and the fifth phase hole 562 are rotated to the highest position, the power transmission device 5 is rotated at the third angle. Since none of any elements is installed on this phase, this phase belongs to an empty trip. In the present invention, the phase corresponded to the third angle is utilized to return the ink stack assembly 3 and the scraper assembly 4 to the original position.

Figure 6:
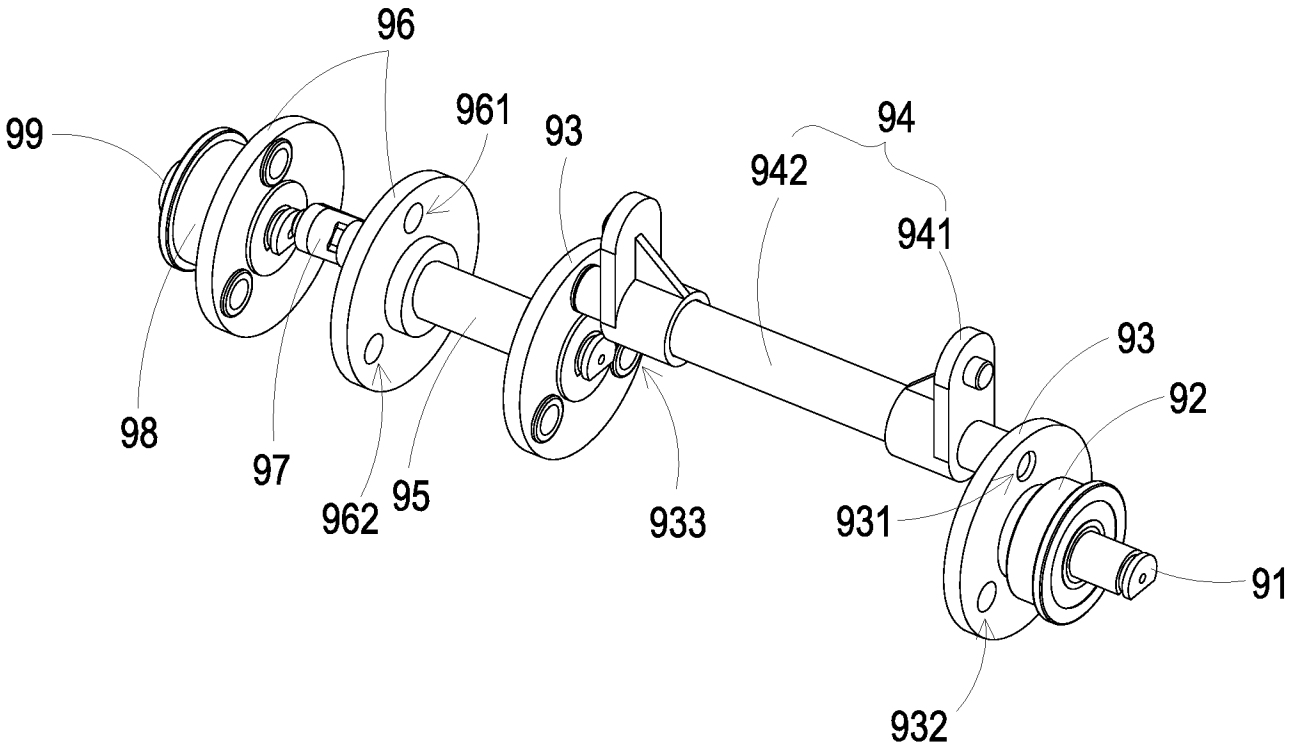
FIG. 6 schematically illustrates the detailed structure of a power transmission device of a printer clean system according to an embodiment of the present invention.

Please refer to FIG. 6. FIG. 6 schematically illustrates the detailed structure of a power transmission device of a printer clean system according to an embodiment of the present invention. As shown in FIG. 6, the power transmission device of the present invention can be a power transmission device 9. The power transmission device 9 includes a polygonal shaft 91, a first receiving portion 92, two first round cranks 93, a first connection rod 94, a transmission rod 95, two second round cranks 96, a second connection rod 97, a second receiving portion 98 and a fixing shaft 99. The polygonal shaft 91, the first receiving portion 92, the first connection rod 94, the transmission rod 95, the second connection rod 97, the second receiving portion 98 and the fixing shaft 99 are similar with the polygonal shaft 51, the first receiving portion 52, the first connection rod 54, the transmission rod 55, the second connection rod 57, the second receiving portion 58 and the fixing shaft 59, so they are not redundantly described herein. In this embodiment, the first cranks 53 and the second cranks 56 are replaced by the first round cranks 93 and the second round cranks 96. The exteriors of the first cranks 53 and the first round cranks 93 are obviously different, and the exteriors of the second cranks 56 and the second round cranks 96 are obviously different. However, the first round cranks 93 have the first phase holes 931, the second phase holes 932 and the third phase holes 933 in common with the first cranks 53. The second round cranks 96 have the fourth phase hole 961, the fifth phase hole 962 and the third phase holes (not shown) in common with the second cranks 56. Each phase difference between the two adjacent phase holes is 120 degrees, so the effect of the phase switching described above can be achieved. The power transmission device 9 can be utilized according to the practical demands.

From the above description, the present invention provides a printer clean system. By rotating the power transmission device to the first angle, the second angle and the third angle, the ink stack assembly is respectively brought to an ink stack clean position, an ink stack return position and the ink stack return position by the power transmission device, and the scraper assembly is simultaneously brought to a scraper return position, a scraper clean position and the scraper return position by the power transmission device. In other words, through the different phases of the power transmission device of the printer clean system, the ink stack cleaning, the scraper cleaning, and the ink stack returning and the scraper returning are continuously and respectively performed. Since the actions are interactively and continuously operated, the operation error is extremely small, hence the clean effectivity is effectively enhanced, and the pollution problems are avoided. Meanwhile, since the power transmission device is specially designed, the printer clean system can be driven by a single driving device. Not only the utilized materials are less, but also the cost of assemblies are lower. Meanwhile, because the control of single driving is easier, the advantages of accurately controlling and adjusting the contact area and the cleaning force during cleaning are achieved.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A printer clean system, comprising:

a base having a first accommodation groove and a second accommodation groove, wherein the first accommodation groove is disposed adjacent to the second accommodation groove;

an ink stack assembly disposed on the first accommodation groove;

a scraper assembly disposed on the second accommodation groove;

a power transmission device penetrated through the first accommodation groove and the second accommodation groove and connected with the ink stack assembly and the scraper assembly; and a driving device connected with the power transmission device for driving the power transmission device, wherein when the power transmission device is rotated to a first angle, the ink stack assembly is brought to an ink stack clean position by the power transmission device, and the scraper assembly is brought to a scraper return position by the power transmission device, when the power transmission device is rotated to a second angle, the ink stack assembly is brought to an ink stack return position by the power transmission device, and the scraper assembly is brought to a scraper clean position by the power transmission device, and when the power transmission device is rotated to a third angle, the ink stack assembly is brought to the ink stack return position by the power transmission device, and the scraper assembly is brought to the scraper return position by the power transmission device.

2. The printer clean system according to claim 1, wherein the power transmission device comprises:

two first cranks, each of the first cranks has a first phase hole, a second phase hole and a third phase hole, wherein a phase difference between the first phase hole and the second phase hole is 30 to 120 degrees, a phase difference between the second phase hole and the third phase hole is 30 to 120 degrees, and a phase difference between the third phase hole and the first phase hole is 30 to 120 degrees;

a first connection rod disposed between the two first cranks and installed on corresponded the two first phase holes of the two first cranks;

two second cranks, each of the second cranks has a fourth phase hole, a fifth phase hole and a sixth phase hole, wherein a phase difference between the fourth phase hole and the fifth phase hole is 30 to 120 degrees, a phase difference between the fifth phase hole and the sixth phase hole is 30 to 120 degrees, a phase difference between the sixth phase hole and the fourth phase hole is 30 to 120 degrees, and the fourth phase hole, the fifth phase hole and the sixth phase hole are respectively corresponded to the first phase hole, the second phase hole and the third phase hole;

a second connection rod disposed between the two second cranks and installed on corresponded the two sixth phase holes of the two second cranks; and a transmission rod disposed between the first connection rod and the second connection rod and respectively connected to one of the two first cranks and one of the two second cranks.

3. The printer clean system according to claim 2, wherein the power transmission device further comprises a first receiving portion and a second receiving portion, one of the two first cranks is pivotally disposed on the first receiving portion, and one of the two second cranks is pivotally disposed on the second receiving portion.

4. The printer clean system according to claim 3, wherein the power transmission device further comprises a polygonal shaft, wherein the polygonal shaft is pivotally disposed on the first receiving portion, and the polygonal shaft, the first receiving portion, the first crank pivotally disposed on the first receiving portion, the first connection rod, the first crank connected to the transmission rod, the transmission rod, the second crank connected to the transmission rod, the second connection rod, the second crank pivotally disposed on the second receiving portion and the second receiving portion are sequentially arranged.

5. The printer clean system according to claim 4, wherein the driving device is a motor, a rotating shaft of the motor is connected with the polygonal shaft, and the polygonal shaft, the two first cranks, the transmission rod and the two second cranks are coaxially rotated.

6. The printer clean system according to claim 2, wherein the ink stack assembly comprises at least an ink stack and a first body, each ink stack is disposed on the first body, each of the ink stack has an ink absorption head, and when the ink stack assembly is located at the ink stack clean position, each of the ink absorption head is correspondingly contacted with an ink cartridge.

7. The printer clean system according to claim 6, wherein the first connection rod comprises at least a first connection portion and a first rod, the first connection portion is disposed on the first rod, the first connection portion has a first engaging portion, and the first engaging portion is engaged with a first engaging hole of the first body so as to be located.

8. The printer clean system according to claim 6, wherein the scraper assembly comprises a scraper and a second body, wherein the scraper is disposed on the second body.

9. The printer clean system according to claim 8, wherein the second connection rod comprises at least a second connection portion and a second rod, the second connection portion is disposed on the second rod, the second connection portion has a second engaging portion, and the second engaging portion is engaged with a second engaging hole of the second body so as to be located.

10. The printer clean system according to claim 1, wherein the volume of the first accommodation groove is larger than the volume of the second accommodation groove.

* * * * *